US008296888B2

(12) United States Patent
Yoo et al.

(10) Patent No.: US 8,296,888 B2
(45) Date of Patent: Oct. 30, 2012

(54) LAUNDRY TREATING MACHINE AND CONTROL METHOD OF THE SAME

(75) Inventors: Hea Kyung Yoo, Seoul (KR); Sog Kie Hong, Seoul (KR); Dong Won Kim, Seoul (KR); Jong Seok Kim, Seoul (KR); Dae Yun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 415 days.

(21) Appl. No.: 12/385,067

(22) Filed: Mar. 30, 2009

(65) Prior Publication Data

US 2009/0241269 A1 Oct. 1, 2009

(30) Foreign Application Priority Data

Apr. 1, 2008 (KR) ..... 10-2008-0030390

(51) Int. Cl.

| | |
|---|---|
| ***D06B 19/00*** | (2006.01) |
| ***F26B 19/00*** | (2006.01) |
| ***F26B 7/00*** | (2006.01) |
| ***F26B 3/00*** | (2006.01) |

(52) U.S. Cl. ..... 8/149.3; 8/149.2; 34/90; 34/427; 34/443

(58) Field of Classification Search ..... None
See application file for complete search history.

(56) References Cited

U.S. PATENT DOCUMENTS

| | | | | |
|---|---|---|---|---|
| 2005/0044744 | A1 * | 3/2005 | Tadano et al. | 34/596 |
| 2009/0056034 | A1 * | 3/2009 | Herkle et al. | 8/149.3 |

FOREIGN PATENT DOCUMENTS

| | | | |
|---|---|---|---|
| EP | 1 584 728 | | 10/2005 |
| JP | 2008-110323 | | 5/2008 |
| WO | WO 01/11134 | | 2/2001 |
| WO | WO 0111134 | A1 * | 2/2001 |
| WO | WO 2006/090973 | | 8/2006 |
| WO | WO 2006/101345 | | 9/2006 |
| WO | WO 2006/101361 | | 9/2006 |
| WO | WO 2006101361 | A1 * | 9/2006 |
| WO | WO 2008030066 | A2 * | 3/2008 |

* cited by examiner

*Primary Examiner* — Michael Kornakov

*Assistant Examiner* — Nicole Blan

(74) *Attorney, Agent, or Firm* — McKenna Long & Aldridge LLP

(57) ABSTRACT

The present disclosure generally relates to a cloth treating apparatus, such as a laundry treating machine, and methods of control and operation which sanitize the machine. The laundry treating machine can include an accommodating space which supplies air and moisture in order to remove unpleasant odors, wrinkles, or dampness from the laundry. The laundry treating machine may further include a circulation duct to circulate, dehumidify, or heat air inside the accommodating space. Operation of the laundry treating machine can use steam-sanitizing to remove odors, moisture, bacteria from the accommodating space and circulation duct. Steam-sanitizing can be performed based on a user's selection or the occurrence of a condition, such as unloading of laundry from the accommodating space after treatment.

7 Claims, 6 Drawing Sheets

LAUNDRY TREATING MACHINE AND CONTROL METHOD OF THE SAME

CROSS REFERENCE TO RELATED APPLICATION

This application claims the benefit of Korean Patent Application No. 10-2008-0030390, filed on Apr. 1, 2008, which is hereby incorporated by reference as if fully set forth herein.

BACKGROUND OF THE DISCLOSURE

1. Field of the Disclosure

The present disclosure generally relates to laundry treating machines. More specifically, the present disclosure relates to methods of controlling a laundry treating machine, which keep the interior of the laundry treating machine clean.

2. Discussion of the Related Art

Generally described, laundry treating machines can be electric appliances which treat laundry, such as clothes, clothing items, fabrics, and the like. Typically, laundry can be placed in an accommodating space of a cabinet of the laundry treating machine, and a series of processes are executed to supply air and moisture to the laundry to remove unpleasant odors, wrinkles, and dampness. When moisture is supplied to the accommodating space, minute water elements combine with odor elements that remain deep in fibrous tissues of the laundry. The combined water and odor elements can then be ventilated to dry the laundry and remove odors and wrinkles.

Often, the laundry treating machine includes a circulation duct provided below the accommodating space to dehumidify, heat, and circulate air inside the accommodating space. Unfortunately when moisture or hot air are repeatedly supplied to the laundry treating machine by the circulation duct, the humidity level inside the accommodating space and circulation duct may fluctuate. For example, when steam is supplied the humidity may increase and when hot air is supplied the humidity may decrease.

This can be problematic because after the laundry treating machine finishes drying the laundry using hot air, some of the supplied moisture may remain in the accommodating space and circulation duct. Unfortunately, these high temperature and humidity environments can lead to hygiene and sanitizing problems because the water which condenses from humid air inside the accommodating space can be unclean and contain unpleasant odors and foreign substances. If the condensed water is left alone in the laundry treating machine, bacteria and odors can proliferate.

SUMMARY OF THE DISCLOSURE

The present disclosure generally relates to a cloth treating apparatus, such as a laundry treating machine, and methods of control and operation which sanitize the machine. The laundry treating machine can include an accommodating space which supplies air and moisture in order to remove unpleasant odors, wrinkles, or dampness from the laundry. The laundry treating machine may further include a circulation duct to circulate, dehumidify, or heat air inside the accommodating space. Operation of the laundry treating machine can use steam-sanitizing to remove odors, moisture, bacteria from the accommodating space and circulation duct. Steam-sanitizing can be performed based on a user's selection or the occurrence of a condition, such as unloading of laundry from the accommodating space after treatment.

Advantages and features of the disclosure in part may become apparent in the description which follows and in part may become apparent to those having ordinary skill in the art upon examination of the following or may be learned from practice of the disclosure. The advantages and features of embodiments of the present disclosure may be realized and attained by the structures and processes described in the written description, the claims, and in the appended drawings.

To achieve these advantages and features and in accordance with the purpose of the present disclosure, as embodied and broadly described herein, a control method of a laundry treating machine including a mode selecting step selecting an operation mode of steam sanitizing an accommodating space; a steam supplying step supplying steam generated by a steam generator to the accommodating space; and a steam sanitizing step maintaining the temperature of the accommodating space at a predetermined value or higher for a predetermined time period or more is provided.

The steam sanitizing step may control the steam generator to meet a steam sanitization condition that the temperature inside the accommodating space is maintained at 60° C. or higher for 10 minutes or more. The steam generator may be turned on and off repeatedly within a predetermined range meeting the steam sanitization condition of the accommodating space. The control method may further include a drying step drying the accommodating space after the steam sanitizing step is complete.

In an embodiment, a control method of a laundry treating machine including a mode selecting step selecting an operation mode of steam-sanitizing a circulation duct circulating air inside an accommodating space receiving laundry or steam-sanitizing a circulation duct and an accommodating space; and a steam supplying step supplying steam generated by a steam generator to the circulation duct or both of the accommodating space and the circulation duct is provided. The control method can further include a fan control step circulating air inside the circulation duct and the accommodating space and a steam-sanitizing step maintaining the temperature of the accommodating space or the circulation duct at a predetermined value or higher for a predetermined time period or more.

In some embodiments, if the circulation duct steam-sanitizing mode is selected in the mode selecting step, the steam supplying step may supply steam to the circulation duct and the fan control step operates the fan. If an accommodating space and circulation duct steam-sanitizing mode is selected in the mode selecting step, the steam supplying step may supply steam to both of the accommodating space and the circulation duct and the fan control step operates the fan. The steam supplying step may supply steam to either of the accommodating space and the circulation duct first. The steam supplying step may supply steam to the accommodating space first.

The fan control step may be performed after the steam starts to be supplied to either of the accommodating space and the circulation duct. The steam sanitizing step may control the steam generator to meet a steam sanitizing condition that the temperature inside the accommodating space or the circulation duct is maintained at 60° C. or higher for 10 minutes or more. The steam generator may be turned on and off repeatedly in a predetermined range meeting the steam sanitizing condition of the accommodating space and water may be supplied to the steam generator in a state of being turned off.

The control method may further include a drying step drying the accommodating space or the circulation duct after the steam sanitizing step is complete. The circulation duct may include a dehumidifying part dehumidifying humid air inside the accommodating space and a heating part heating the dehumidified air. The steam supplying step may supply steam in front of the dehumidifying part. The circulation duct may include a dehumidifying part humid air inside the accommodating space and a heating part heating the dehumidified air. The steam supplying step may supply steam in front of the dehumidifying part.

Exemplary embodiments of a laundry treating machine including a cabinet having an accommodating space receiving laundry; a circulation duct circulating air inside the accommodating space; a fan sucking air inside the accommodating space into the circulation duct and discharging air into the accommodating space; first and second steam spraying units provided in the accommodating space and the circulation duct, respectively, to selectively spray steam; a steam generator supplying steam to the first and second steam spraying units; and a controller controlling the steam generator and the fan is provided. The circulation duct may include a dehumidifying part dehumidifying humid air inside the accommodating space and a heating part heating the dehumidified air. The second steam spray unit may be provided in front of the dehumidifying part within the circulation duct.

It is to be understood that both the foregoing general description and the following detailed description are exemplary and explanatory and should not be construed as limiting the scope of the claims.

BRIEF DESCRIPTION OF THE DRAWINGS

The accompanying drawings are included to provide a further understanding of the invention, and are incorporated herein and constitute a part of this application. The drawings together with the description serve to explain exemplary embodiments of the present invention. In the drawings.

DESCRIPTION OF THE EMBODIMENTS

Reference will now be made in detail to the specific embodiments of the present disclosure, examples of which are illustrated in the accompanying drawings. Wherever possible, the same reference numbers will be used throughout the drawings to refer to the same or like parts.

Figure 1:
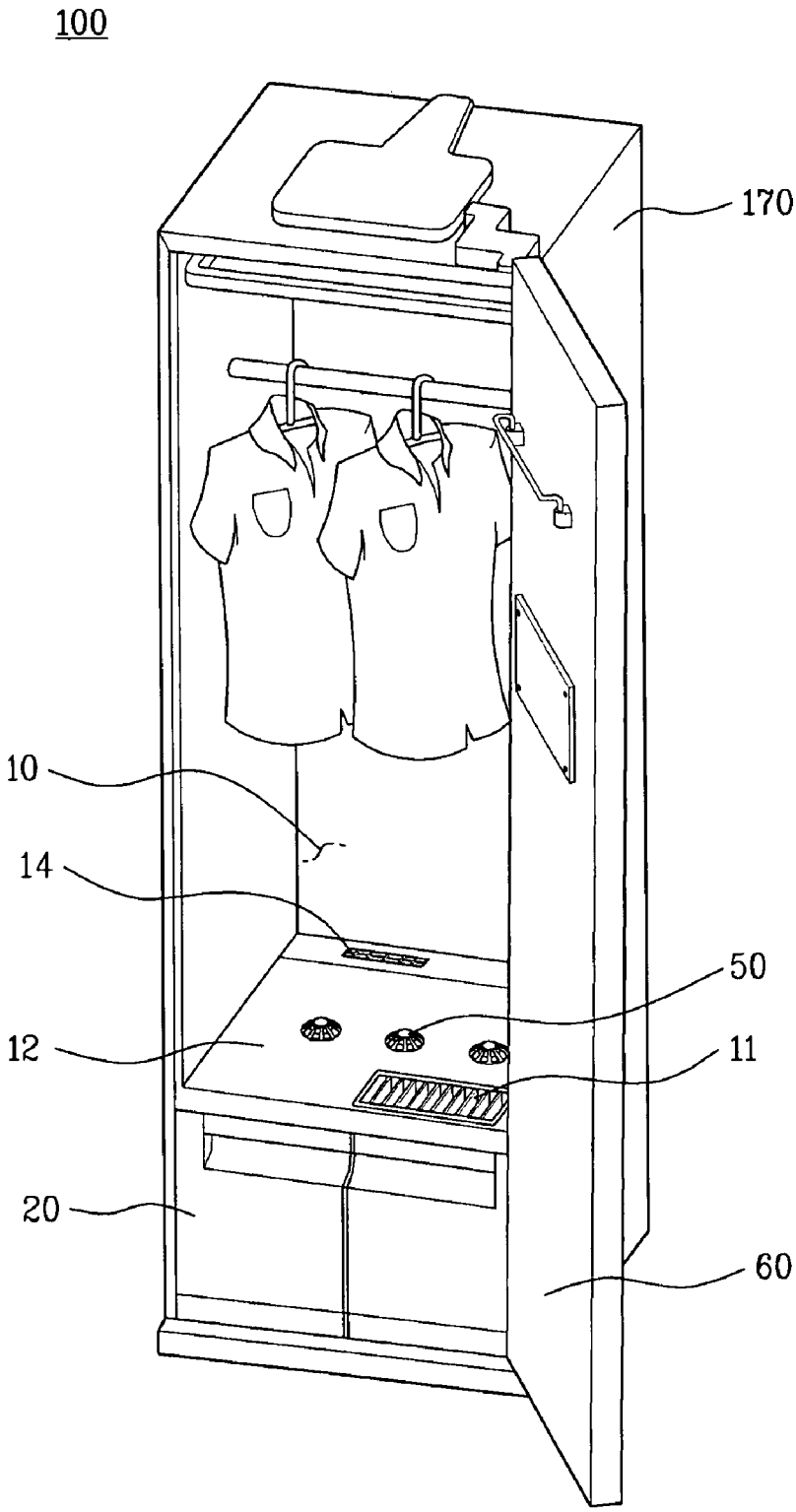
FIG. 1 illustrates a perspective view of a laundry treating machine and controls, according to an embodiment of the invention.

FIG. 1 illustrates a perspective view of a laundry treating machine 100 and controls. Laundry treating machine 100 can include an accommodating space 10 which receives laundry and a mechanism room 20 provided under the accommodating space 10. Accommodating space 10 and mechanism room 20 may be provided in a single cabinet 170. In addition, accommodating space 10 can be closed off from outside the laundry treating machine 100 by a door 60.

Mechanism room 20 can include various components to circulate, dehumidify or heat air inside the accommodating space 10 in order to remove unpleasant odors or odors, wrinkles, and humidity from the laundry. The mechanism room 20 can draw in air from the accommodating space 10 and re-supply air, such as heated air, or moisture to the accommodating space 10. At a bottom 12 of the accommodating space 10 an inlet 11 can be provided through which the air of the accommodating space 10 may be drawn into the mechanism room 20. An outlet 14 can also be provided at the bottom 12 of the accommodating space 10 through which air can be re-supplied to the accommodating space 10.

Inlet 11 and outlet 14 can be provided at the bottom 12 of the accommodating space 10 because mechanism room 20 may be provided underneath the accommodating space 10. Of note, inlet 11 and outlet 14 may be positioned elsewhere, and this may depend on the position of mechanism room 20 relative to accommodating space 10. The shape and structure of inlet 11 and outlet 14 can be selected to prevent external foreign substances larger than a predetermined size from being inserted or getting caught inside inlet 11 and outlet 14. For example, inlet 11 and outlet 14 can have a net-shaped structure.

Laundry treating machine 100 may further include a moisture supply device (not shown) which supplies moisture to the accommodating space 10 holding the laundry. The moisture supply device can supply sprayed water or steam. Moisture supply device may supply moisture to the laundry in the accommodating space 10 uniformly. In exemplary embodiments, moisture supply device can include a steam generator which generates steam to supply to the accommodating space 10. The steam generator may be provided inside the mechanism room 20. When steam is generated by the steam generator, it can be sprayed at laundry by a steam spraying unit 50 provided inside accommodating space 10.

Figure 2:
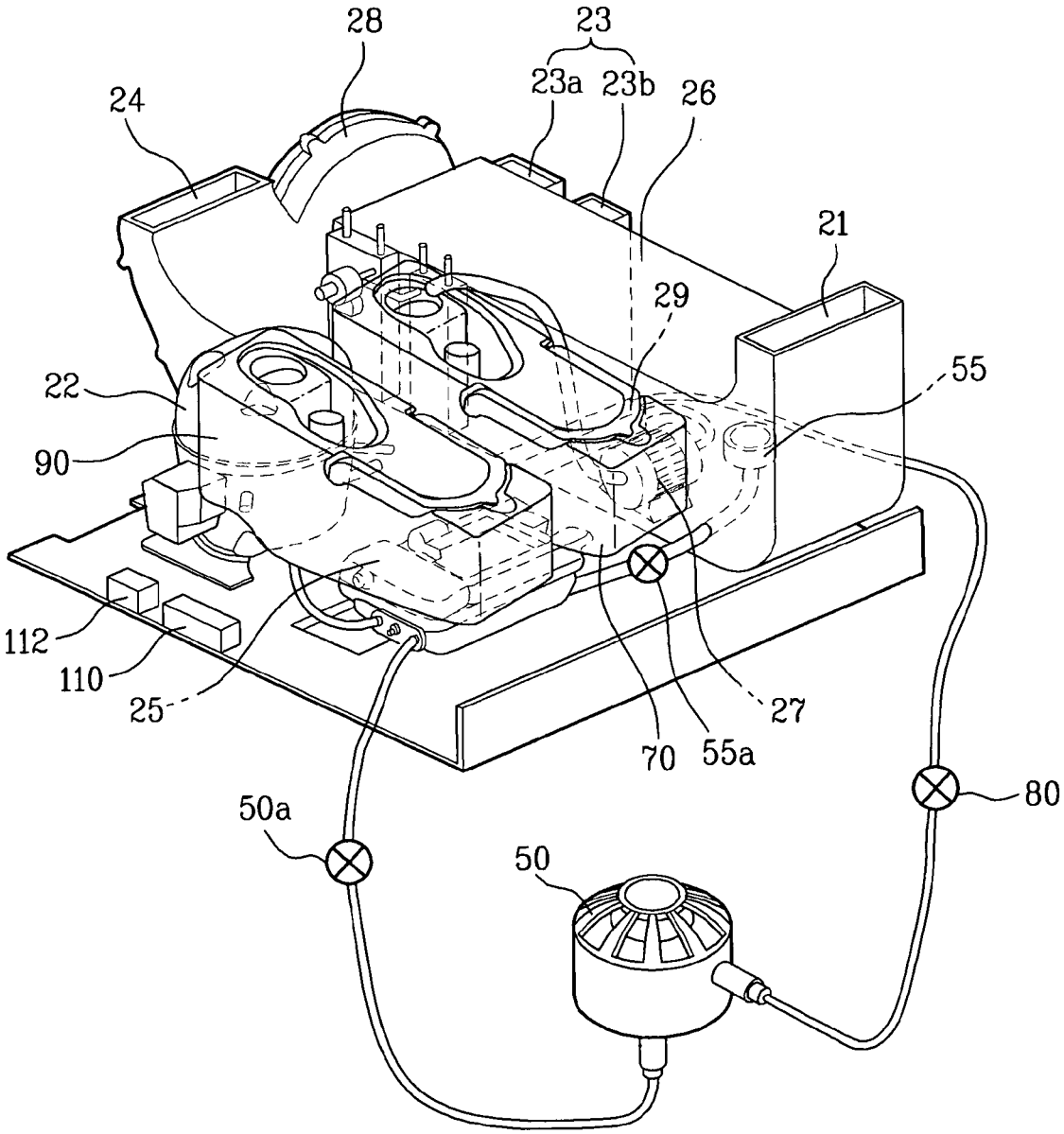
FIG. 2 illustrates a perspective view of an inner structure of the mechanism room of FIG. 1, according to an embodiment of the invention.

FIG. 2 illustrates a perspective view of an inner structure of the mechanism room 20. Mechanism room 20 can include a steam generator 25 and a circulation duct 26. Steam generator 25 can generate steam to supply to the accommodating space 10. The circulation duct 26 can draw in humid air from inside the accommodating space 10 for dehumidification and heating. Circulation duct 26 can include an inlet hole 21 which is in communication with inlet 11 of accommodating space 10.

Circulation duct 26 can also include a ventilation function to circulate unheated air. For example a ventilation duct 28 may be provided which has a fan to discharge air passed through circulation duct 26 via the outlet 14. Ventilation duct 28 can include an outlet hole 24 which is in communication with outlet 14 of accommodating space 10.

In an embodiment, circulation duct 26 can have a heat pump or an electric heater to heat or dehumidify air. A heat pump or electric heater can be used to heat air and to re-supply air to the accommodating space 10. For example, when air is drawn via the inlet hole 21 from the accommodating space 10, the moisture of the air may condensed and the air can be dehumidified by the heat pump and/or electric heater.

Of note, when a heat pump is used to heat air for re-supplying to the accommodating space 10, a compressor and a heat exchanger can be used. The heat exchanger 23 may include a condensing part 23*b* and a heating part 23*a*. Condensing part 23*b* can evaporate refrigerant which may be compressed by the compressor 22 in the circulation duct 26 to dehumidify the humid air. Heating part 23*a*, can condense the refrigerant to heat the dehumidified air. An auxiliary electric heater can also be used to heat the dehumidified air sufficiently.

Laundry treating machine 100 can have a drying function which includes condensation, circulation, and/or exhaustion type drying. For example, air drawn-in from the accommodating space 10 may be dehumidified and can then be re-supplied to the accommodating space 10 during the condensation or circulation drying, or exhausted outside during the exhaustion drying. In some embodiments, laundry treating machine 100 may dehumidify the air inside the accommodating space 10 and then re-circulate the air.

Heat exchanger 23 can dehumidify humid air circulated in the accommodating space 10. In an embodiment, heat exchanger 23 can use refrigerant supplied from the compressor 22 during a refrigerant evaporation process and may reheat the air dehumidified during the refrigerant condensation process. As a result, the air drawn into the circulation duct 26 can be dehumidified by the condensation part 23*b* and heated by the heating part 23*a*. The heated air can then be re-supplied to the accommodating space via the ventilation duct 28.

Mechanism room 20 can include a compressor 22 to compress the refrigerant. Compressor may compress refrigerant during the refrigerant evaporation and condensation process.

The mechanism room 20 may also include a water drainage box 70 which can be separable from mechanism room 20 or an external water drainage pipe, for example. In some embodiments, a water collecting part 29 can be positioned under the heat exchanger 23 and used to collect water condensed at the heat exchanger 23 temporarily, for example. The contaminated water in water collecting part 29 may then flow into the water drainage box 70 for storage. Water collecting part 29 can also collect water condensed from the accommodating space 10 and/or water remaining in the steam generator 25 before it flows into the water drainage box 70.

A water drainage pump 27 may be used to move the contaminated or condensed water from the water collecting part 29 to the water drainage box 70. Of note, water drainage pump 27 may be mounted inside the water collecting part 29 and the water collecting part 29 may further include a water level sensor (not shown). Because contaminated water can be moved to the water drainage box 70 from the water collecting part 29 by water drainage pump 27, the size of the water collecting part 29 may be substantially smaller than water drainage box 70. When the capacity of the water drainage box nears full, a user of the laundry treating machine 100 can separate the water drainage box 70 from the mechanism room 20 and remove the collected water from the water drainage box 70.

In some embodiments, the water drainage box 70 can be installed under the heat exchanger 23. When this occurs, the water collecting part 29 may not be used. The water drainage box 70 may be provided in an upper portion of the mechanism room 20. Installing the water drainage box 70 in the upper portion of the mechanism room 20 can allow a user to easily separate the water drainage box 70. A pump can be used to compensate for the height difference and allow water to flow into water drainage box 70.

Of note, water drainage box 70 and a water supply box 90 (as described below) may be configured to be movable or rotatable from the mechanism room 20. In exemplary embodiments, drainage box 70 and a water supply box 90 can be installed as a drawer and be moveable in a forward and rearward direction. Alternatively, water drainage box 70 and a water supply box 90 may be hingedly rotatable.

Mechanism room 20 can include a water supply box 90 to supply water to steam generator 25 for heating and generating steam. Water supply box 90 may be a water containing box which may be separable from the mechanism room 20 or an external water supply pipe. It may be advantageous to make water supply box 90 separable when the amount of steam to generate may be substantially small and water supply and drainage facilities are not readily available. Water supply box 90 may also be directly connected with the water supply and drainage facilities. A pipe can be provided to drain the water from the water collecting part 29 and/or connected with water drainage box 70 to provide water to the water drainage facilities (not shown).

Steam spraying unit(s) can be used to spray steam generated by the steam generator 25 into accommodating space 10. Steam can be sprayed into the accommodating space 10 to steam-sanitize the inside of the accommodating space 10 or circulation duct 26 and remove unpleasant odors and wrinkles from laundry. In the illustrated embodiments, steam spraying unit(s) can include a first spraying unit 50 which sprays steam into the accommodating space 10, and a second steam spraying unit 55 which sprays steam into circulation duct 26. Steam can be sprayed and circulated in circulation duct 26 by second steam spray unit 55 in order to sanitize circulation duct 26.

Second steam spraying unit 55 can be positioned inside circulation duct 26 or placed in a predetermined position to spray steam into the circulation duct 26. For example, when second steam spraying unit 55 may be placed in front of the condensation part 23*b* of heat exchanger 23, the steam can be drawn-in and the inside of circulation duct 26 can be sterilized. To generate steam, first and second steam spraying units 50, 55 can heat a predetermined amount of water held in a water tank. In alternative embodiments, a heater can be installed around a water supply hose to generate steam. Of note, steam generator 25 can be used.

In some embodiments, when steam may be generated by first 50 or second 55 steam spraying units, water remaining inside the steam generator 25, such as condensed water, can be drained into water drainage box 70 after being collected in water collecting part 29. This can occur even when steam is not generated. In an embodiment, water condensed from the steam may be directly supplied to the water collecting part 29 or to the inside of the circulation duct 26 connected with the water collecting part 29 so it can be directly drained into the water drainage box 70. The water condensed from the steam and the water condensed at the condensation part 23*b* may then be drained into the water drainage box 70 via the water collecting part 29.

When water condenses within the steam spraying unit(s) (such as, 50 and 55), it may be drained immediately, or it may wait to be drained. Because the water condensed from the steam is at a high temperature, the condensed water can remain in the steam spraying unit(s) for a predetermined time period to be gasified, in some embodiments. In addition, if condensed water remains, the inner space of the steam spraying unit 50, 55 may be reduced to spray the steam efficiently. The high temperature condensed water can be used to keep the steam warm. A valve 80 can be provided between the steam spraying unit 50, 55 and the water collecting part 29 to keep the condensed water in the steam spraying unit(s) for a predetermined time period.

Condensed water may pass water collecting part 29 and be supplied to the water drainage box 70 directly. In some embodiments, the condensed water may also be drained together with condensed water from the heat exchanger 23 into water drainage box 70 by water drainage pump 27 after being stored in water collecting part 29.

Figure 3:
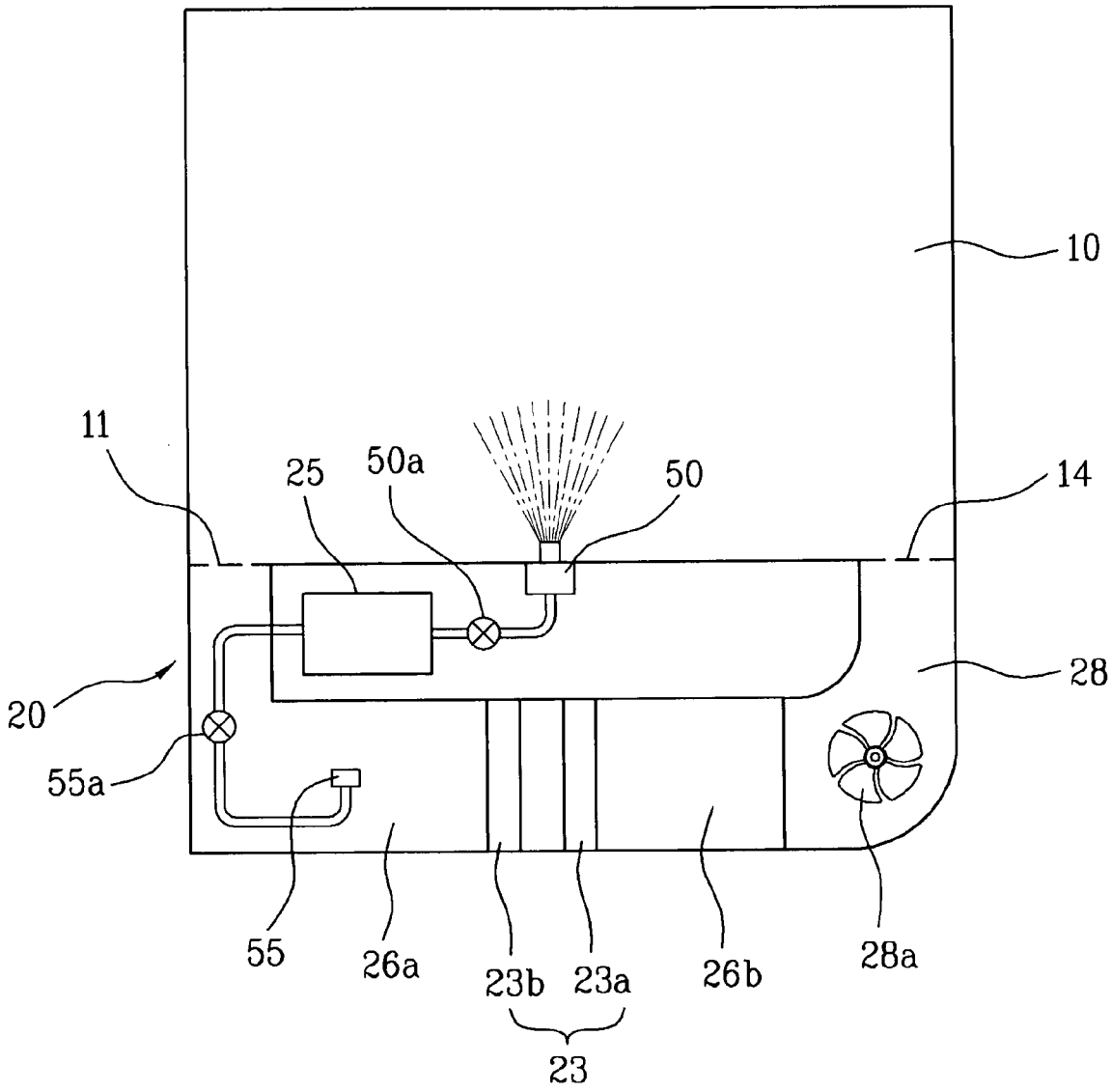
FIG. 3 illustrates an accommodating space steam-sanitizing mode (A), according to an embodiment of the invention.
Figure 4:
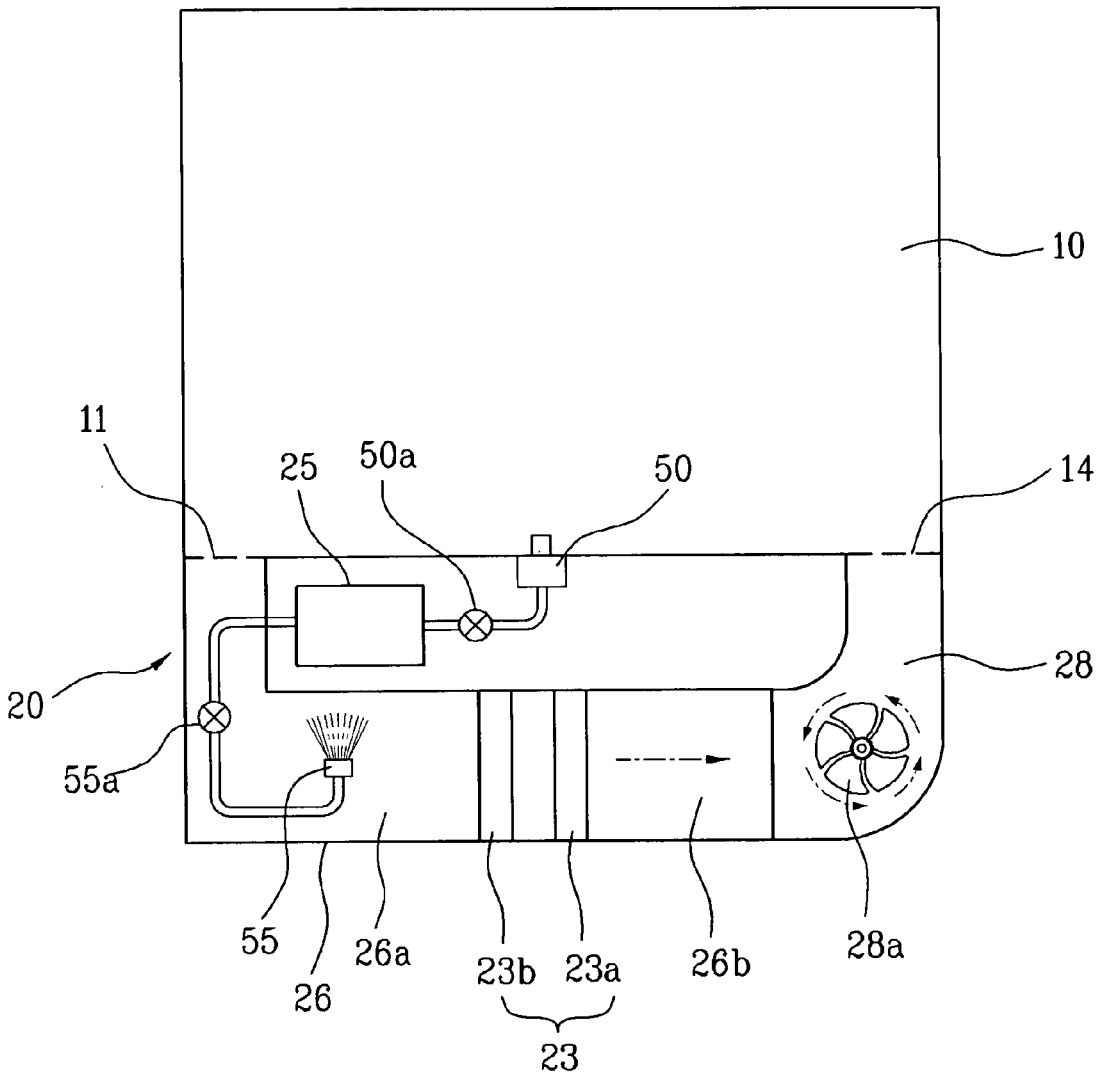
FIG. 4 illustrates a circulation duct steam-sanitizing mode (B), according to an embodiment of the invention.
Figure 5:
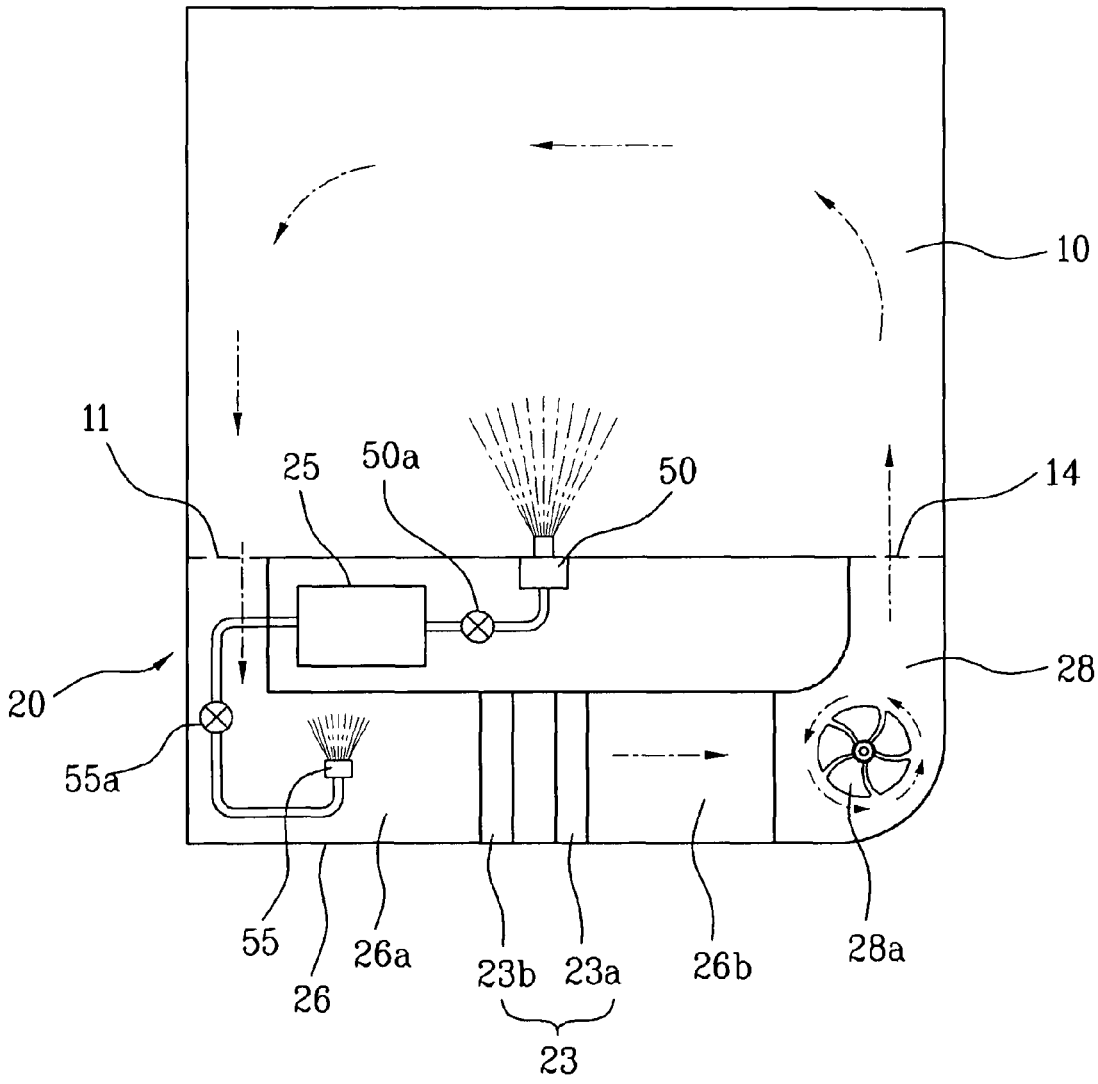
FIG. 5 illustrates an accommodating space and circulation duct steam-sanitizing mode (C), according to an embodiment of the invention.

FIGS. 3-5 illustrate an accommodating space steam-sanitizing mode (A), a circulation duct steam-sanitizing mode (B), and an accommodating space and circulation duct steam-sanitizing mode (C), respectively. To sanitize the insides of the accommodating space 10 and the circulation duct 26, a controller 110 can execute commands stored in a memory 112, which will cause the steam generator 25 and fan 28*a* to be exercised in accordance with predefined parameters. Fan 28*a* can be provided in ventilation duct 28 (adjacent to the circulation duct 26) in order draw in or discharge air from accommodating space 10. In addition, each of the steam spraying units 50, 55 and/or fan 28*a* can supply sprayed steam to the inside of accommodating space 10 and circulation duct 26 uniformly, for example.

In some embodiments, a mode, such as (A), (B), and (C) may steam-sanitize accommodating space 10, circulation duct 26, or both. The accommodating space steam-sanitizing mode (A) can steam-sanitize the inside of the accommodating space 10. The circulation duct steam-sanitizing mode (B) can steam-sanitize the inside of the circulation duct 26. The accommodating space/circulation duct steam-sanitizing mode (C) can steam-sanitize the inside of the accommodating space 10 and the circulation duct 26. Of note, other modes can be used to steam-sanitize other parts of laundry treating machine 100. When a mode is selected, steam can then be supplied for steam-sanitizing based on the selected mode. For example, first steam spraying unit 50 can be used to spray steam into the accommodating space 10 during modes (A) and (C). In addition, second steam spraying unit 55 can be used to spray steam into the circulation duct 26 during modes (B) and (C).

Steam can be used to increase the temperature for a time period of accommodating space 10 and/or circulation duct 26 for sanitizing purposes. For example, the temperature of accommodating space 10 and the circulation duct 26 can be maintained at 60° C. or higher for 10 minutes or more by steam sprayed from the steam generator 25. Bacteria in the accommodating space 10 and/or the circulation duct 26 may then be removed and/or stop proliferating.

Other configurations, conditions, or criteria can be used to steam-sanitize the inside of accommodating space 10 and circulation duct 26. For example, when the inside of the accommodating space 10 and circulation duct 26 may be higher than 60° C., the duration of the time period may be less than 10 minutes. However, the capacity of the steam generator 25 may affect the temperature which accommodating space 10 and/or circulation duct 26 can be heated to.

As shown in FIG. 3, steam can be sprayed via the first steam spraying unit 50 to steam-sanitize the inside of accommodating space 10. To maintain the temperature of the accommodating space 10 at 60° C. or higher for approximately 10 minutes or more, steam generator 25 may be turned on and off repeatedly. When steam generator 25 may be in a turned off state, water can be supplied to the steam generator 25 to generate steam. First steam spraying unit 50 can receive steam from steam generator 25. Steam may then be sprayed into the accommodating space 10 via the first steam spraying unit 50.

Steam supply can be controlled by a first control valve 50*a* provided between one or more pipes connecting first steam spraying unit 50 and steam generator 25. First control valve 50*a* may be closable to supply steam to the accommodating space 10. At least one temperature sensor (not shown) may be provided in the accommodating space 10 to measure the temperature. Temperature sensor can determine whether the temperature of accommodating space 10 satisfies the steam-sanitizing conditions. For example, it can be useful to know whether the temperature of accommodating space 10 is maintained at 60° C. or higher by steam sprayed from first steam spraying unit 50.

During accommodating space steam-sanitizing mode (A), steam may not be supplied from the second steam spraying unit 55 to the circulation duct 26. A second control valve 55*a* which controls steam supply to second steam spraying unit 55 can thus remain closed during mode (A). In addition, fan 28*a* provided in ventilation duct 28 can remain off and not rotated. Of note, first and second control valves 50*a* and 55*a* may be electric valves. The openings of first and second control valves 50*a* and 55*a* may be controlled by control part of the laundry treating machine 100.

As shown in FIG. 4, steam can be sprayed via the second steam spraying unit 55 provided in the circulation duct 26 to steam-sanitize the inside of the circulation duct 26. In the illustrated embodiments, because steam is circulated inside circulation duct 26 to increase the temperature, steam may not be sprayed by first steam spraying unit 50 in mode (B). First control valve 50*a* can be closed and second control valve 55*a* can be opened to supply steam from second steam spraying unit 55.

Fan 28*a* of the ventilation duct 28 can then be rotated to pass sprayed steam through heat exchanger 23 in order to supply steam sprayed from the second steam spraying unit 55 to the circulation duct 26. Of note, fan 28*a* may not be operated before second steam spraying unit 55 sprays steam. Steam can be supplied uniformly to circulation duct 26 so that the temperature of circulation duct 26 can be maintained at 60° C. or higher for approximately 10 minutes or more.

As shown in FIG. 5, steam can be sprayed from the first and second steam spraying units 50 and 55 provided in the accommodating space 10 and the circulation duct 26, respectively, to steam-sanitize both accommodating space 10 and circulation duct 26. During accommodating space/circulation duct steam-sanitizing mode (C) air inside accommodating space 10 and circulation duct 26 can be re-circulated. For example, air can be drawn in by circulation duct 26 and re-supplied to accommodating space 10. Both control valves 50*a* and 55*a* can be opened to supply steam.

Fan 28*a* of the ventilation duct 28 can then be rotated to pass sprayed steam through heat exchanger 23 in order to supply steam sprayed from the second steam spraying unit 55 to the circulation duct 26. Of note, fan 28*a* may not be operated before second steam spraying unit 55 sprays steam. Steam can be supplied uniformly to circulation duct 26 so that the temperature of circulation duct 26 can be maintained at 60° C. or higher for approximately 10 minutes or more.

During mode (C), steam can be sprayed by first and second steam spraying units 50 and 55, and fan 28*a* can be operated simultaneously or at different times. In an embodiment, when there is a substantially small difference between the amount of steam sprayed by each unit 50, 55, steam may be sprayed via the first steam spraying unit 50 first to supply steam to the accommodating space 10. This may occur because the volume of circulation duct 26 can be substantially smaller than accommodating space 10. Thus, in order to equalize the finish time of the steam-sanitizing of the accommodating space 10 and the circulation duct 26, it can be advantageous for the steam supplied by the steam generator 25 to heat the accommodating space 10 first and the circulation duct 26 later.

For example, during the middle of when steam is supplied to the accommodating space 10 by first steam spraying unit 50, the second steam spraying unit 55 may begin to supply steam to heat the circulation duct 26. Fan 28*a* can then be operated, and the temperature of accommodating space 10 and circulation duct 26 can be maintained at approximately 60° C. or higher. To complete the steam-sanitizing process, this may occur for approximately 10 minutes or more.

In some embodiments, steam discharged from second steam spraying unit 55 may not be supplied to the heat exchanger and/or used to steam-sanitize the circulation duct 26 immediately after being supplied to the heat exchanger 23. When this occurs, fan 28*a* may be rotated to circulate steam after the ambient temperature near the second steam spraying unit 55 increases to reach a predetermined value.

After steam spraying units 50 and 55 have completed supplying steam during modes (A), (B), and (C), the inside of the accommodating space 10 and circulation duct 26 can be dried. Accommodating space 10 and circulation duct 26 can be dried after steam sanitizing is complete to keep the inside of the accommodating space 10 and circulation duct 26 clean for a substantially long period of time. The heat pump provided in the mechanism room 20 (or a variation) can be operated to dry accommodating space 10 and circulation duct 26. For example, heat pump can dehumidify humid air circulating along the circulation duct 26 at the condensation part 23*b*. The compressor 22 and fan 28*a* provided in the mechanism room 20 can also be operated to dehumidify the humid air inside the circulation duct 26.

Figure 6:
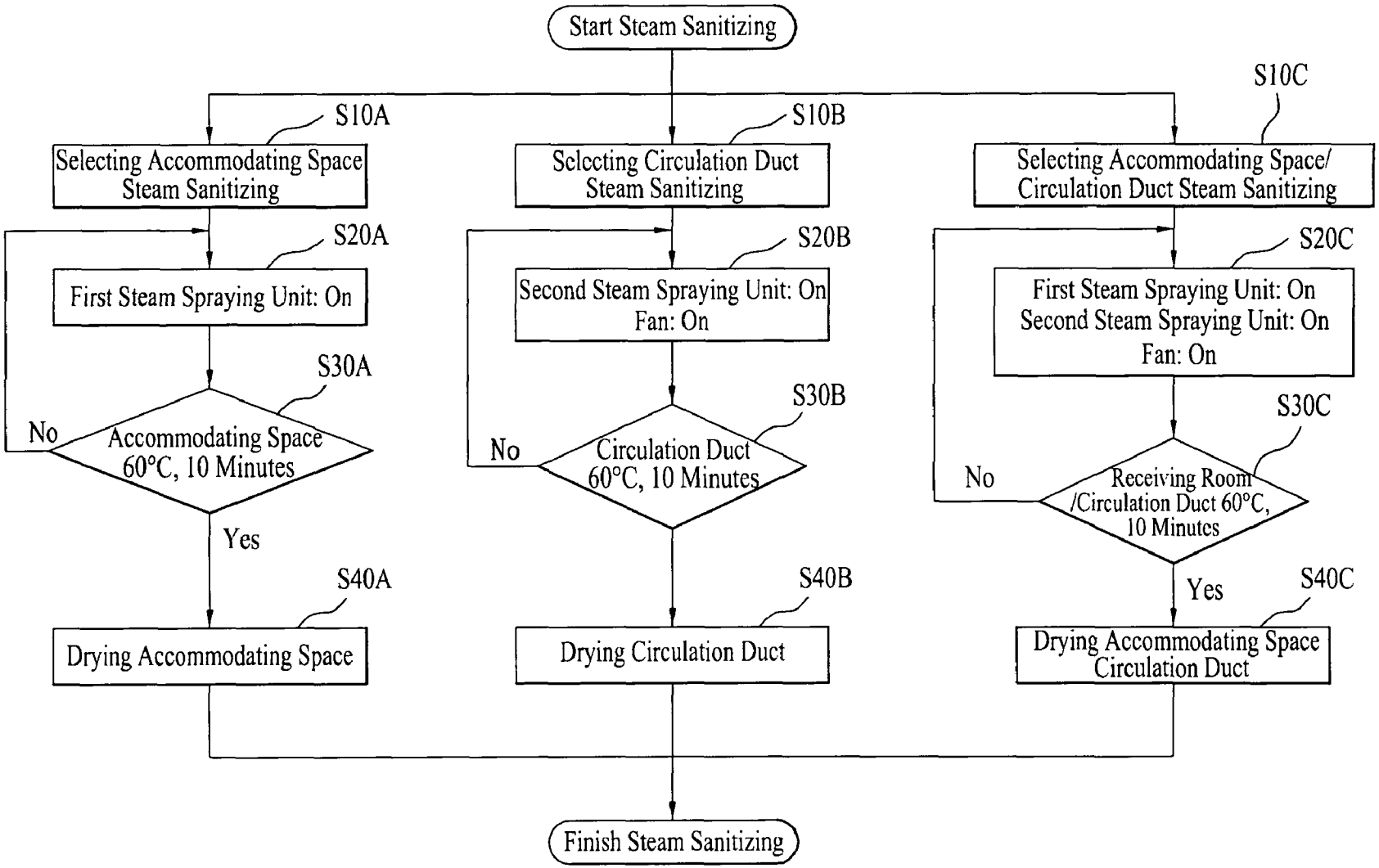
FIG. 6 illustrates a flow chart of an exemplary method of controlling the laundry treating machine of FIG. 1, according to an embodiment of the invention.

FIG. 6 illustrates a flow chart of an exemplary method of controlling the laundry treating machine 100. Beginning in operation blocks S10A, S10B, and S10C, a user can select the accommodating space steam-sanitizing mode (A), the circulation duct steam-sanitizing mode (B), or the accommodating space/circulation duct steam-sanitizing mode (C) in a mode selecting step, using the control part of the laundry treating machine 100, respectively. When this occurs, it can be determined which of first steam spraying unit 50, second steam spraying unit 55, and fan 28*a* to operate based on the selected mode.

Continuing to operations blocks S20A, S20B, and S20C, the steam supplying and fan operation step can be performed based on the selected mode (S10A, S10B and S10C). Also, based on the selected mode, the first 50*a* and second 55*a* control valves can control the steam supplying of the first 50 and second steam spraying units 55.

Moving to operation blocks S30A, S30B, and S30C, the temperature of accommodating space 10 or circulation duct 26 can be measured to determine whether the sanitizing temperature has been maintained, such as approximately 60° C. or higher, for a sanitizing time period, such as approximately 10 minutes or more, by the steam supplied during the steam supplying step (S20A, S20B and S20C), for example.

Based on whether the sanitizing temperature of the accommodating space 10 or the circulation duct 26 has been maintained for the sanitizing time period (e.g. approximately 60° C. or higher for approximately 10 minutes or more), operation blocks S20A, S20B, and S20C may then be repeated. Because the amount of steam supplied by the steam generator 25 can be controllable, the least amount of steam needed to meet the steam-sanitizing condition(s), such as sanitizing temperature (60° C. or higher) for the sanitizing time period (10 minutes or more) may be sprayed. In some embodiments, when the steam generator 25 may not be controllable, the steam generator 25 can be turned on and off repeatedly.

If the accommodating space/circulation duct steam-sanitizing mode (C) is selected, the first steam spraying unit 50 and the second steam spraying unit 55 share the steam generated by the single steam generator 25 (although others can be used). Because of this, the first control valve 50*a* and the second control valve 55*a* may be controlled to measure the temperatures of the accommodating space 10 and the circulation duct 26, and thus to intensively supply the steam to either the accommodating space 10 and the circulation duct 26 depending on which has the relatively lower temperature. When operations blocks S30A, S30B and S30C complete, dryings steps can occur which dry the inside of accommodating space 10 and circulation duct 26.

In some embodiments, the steam-sanitizing of the laundry treating machine 100 can occur after laundry is unloaded (and possibly treated). Heat remaining within the steam generator 25 can be used during steam-sanitizing because the inside of accommodating space 10 or circulation duct 26 may be contaminated. In addition, steam-sanitizing can be performed based on a user's selection of a mode or occur automatically based on a time period or predetermined condition. For example, a predetermined condition can be unloading of laundry from the accommodating space 10 after treatment.

It will be apparent to those skilled in the art that various modifications and variations can be made in the present disclosure without departing from the spirit or scope of the disclosure. Thus, it is intended that the present disclosure cover any modifications and variations within the scope of the appended claims and their equivalents.

What is claimed is:

1. A control method of a laundry treating machine, wherein the laundry treating machine comprising a accommodating space, a circulation duct and a fan and wherein the fan draws air from the accommodating space into the circulation duct and discharging air from the circulation duct into the accommodating space, comprising:

supplying, in response to a selection of an operation mode of steam sanitizing, steam generated by a steam generator to one of:

the accommodating space of the laundry treating machine, the circulation duct of the laundry treating machine, and both the accommodating space and the circulation duct of the laundry treating machine, wherein the fan does not operate so as to prevent steam from getting out the accommodating space when accommodating space steam sanitizing is selected and wherein the fan operates when a circulation duct steam sanitizing is selected;

maintaining a temperature of an inside of the accommodating space, the circulation duct, or both the accommodating space and the circulation duct until a predetermined sanitization condition is met; and drying the inside of the accommodating space, the circulation duct, or both the accommodating space and the circulation duct using a heat pump after the predetermined sanitization condition is met using steam.

2. The control method according to claim 1, wherein circulating air comprises:

operating the fan for a predetermined amount of time.

3. The control method according to claim 2, wherein the fan is operated after the steam begins to be supplied to either of the accommodating space or the circulation duct.

4. The control method according to claim 1, wherein supplying steam generated by a steam generator to both the accommodating space and the circulation duct of the laundry treating machine comprises selectively alternating the supply of steam between the accommodating space and the circulation duct.

5. The control method according to claim 1, wherein maintaining the temperature comprises:

turning a heater of the steam generator on and off repeatedly within a predetermined period.

6. The control method according to claim 5, wherein water is supplied to the steam generator when a heater of the steam generator is in an off state.

7. The control method according to claim 1, wherein the circulation duct comprises a dehumidifying part, configured to dehumidify humid air inside the accommodating space, and a heating part, configured to heat the dehumidified air, and supplying steam comprises:

injecting the steam at a physical location in front of the dehumidifying part.

* * * * *